US008021444B2

(12) United States Patent
Caprotti et al.

(10) Patent No.: US 8,021,444 B2
(45) Date of Patent: Sep. 20, 2011

(54) FUEL OIL COMPOSITIONS

(75) Inventors: Rinaldo Caprotti, Oxford (GB); Graham Jackson, Reading (GB); Martin James Willis, Bitterne (GB)

(73) Assignee: Infineum International Limited, Oxfordshire (GB)

( * ) Notice: Subject to any disclaimer, the term of this patent is extended or adjusted under 35 U.S.C. 154(b) by 475 days.

(21) Appl. No.: 11/946,427

(22) Filed: Nov. 28, 2007

(65) Prior Publication Data

US 2008/0141581 A1 Jun. 19, 2008

(30) Foreign Application Priority Data

Dec. 13, 2006 (EP) ..... 06126052

(51) Int. Cl.
*C10L 1/22* (2006.01)

(52) U.S. Cl. ..... 44/416; 44/418; 44/419

(58) Field of Classification Search ..... 44/347, 44/351, 408, 416, 418, 419
See application file for complete search history.

(56) References Cited

U.S. PATENT DOCUMENTS

| | | | | |
|---|---|---|---|---|
| 3,375,092 A | | 3/1968 | Sweeney | 44/64 |
| 3,615,290 A | * | 10/1971 | Nixon | 44/301 |
| 4,564,460 A | | 1/1986 | Dorer et al. | 252/73 |

FOREIGN PATENT DOCUMENTS

| | | |
|---|---|---|
| EP | 0 632 123 A1 | 1/1995 |
| WO | WO 95/03377 A1 | 2/1995 |

* cited by examiner

*Primary Examiner* — Cephia D Toomer

(57) ABSTRACT

A fuel oil composition is disclosed. The fuel oil includes a major proportion of a fuel oil and minor amounts of: (a) at least one polar nitrogen compound effective as a wax anti-settling additive; and (b) at least one reaction product between a hydrocarbyl-substituted succinic acid or anhydride and hydrazine.

11 Claims, No Drawings

FUEL OIL COMPOSITIONS

This invention relates to fuel oil compositions, and more especially to fuel oil compositions containing detergent species and susceptible to wax formation at low temperatures.

Fuel oils, whether derived from petroleum or from vegetable sources, contain components, e.g., n-alkanes or methyl n-alkanoates, that at low temperature tend to precipitate as large, plate-like crystals or spherulites of wax in such a way as to form a gel structure which causes the fuel to lose its ability to flow. The lowest temperature at which the fuel will still flow is known as the pour point.

As the temperature of the fuel falls and approaches the pour point, difficulties arise in transporting the fuel through lines and pumps. Further, the wax crystals tend to plug fuel lines, screens, and filters at temperatures above the pour point. These problems are well recognised in the art, and various additives have been proposed, many of which are in commercial use, for depressing the pour point of fuel oils. Similarly, other additives have been proposed and are in commercial use for reducing the size and changing the shape of the wax crystals that do form. Smaller size crystals are desirable since they are less likely to clog a filter. The wax from a diesel fuel, which is primarily an alkane wax, crystallizes as platelets. Certain additives inhibit this and cause the wax to adopt an acicular habit, the resulting needles being more likely to pass through a filter, or form a porous layer of crystals on the filter, than are platelets. Other additives may also have the effect of retaining the wax crystals in suspension in the fuel, reducing settling and thus also assisting in prevention of blockages. These types of additives are often termed 'wax anti-settling additives' (WASA).

Many additives have been described over the years for enhancing engine cleanliness, e.g. for reducing or removing deposits in the intake system (e.g. carburetors, intake manifold, inlet valves) or combustion chamber surfaces of spark-ignition engines, or for reducing or preventing injector nozzle fouling in compression-ignition engines.

For example, UK Patent specification No 960,493 describes the incorporation of metal-free detergents, in the form of polyolefin-substituted succinimides of tetraethylene pentamine, in base fuels for internal combustion engines. The use of such metal-free detergents is now widespread. Most commonly used are polyisobutylene substituted succinimides which are the reaction products of polyisobutylene-substituted acylating agents such as succinic acid or anhydride with polyamines. Such materials and their methods of production will be known to those skilled in the art.

The trend in modern diesel engine technology is to increase power output and efficiency by increasing injection pressures and decreasing injector nozzle diameters. Under these conditions, the build up of injector deposits is more likely. This has led fuel manufacturers to produce new types of fuels which are often sold as 'premium' grades and promoted as being effective to improve engine cleanliness. To meet this performance claim, such premium fuels usually contain significantly higher levels of detergent than non-premium grade fuels.

Whilst largely effective with regard to engine cleanliness, a drawback has been identified with the use of high levels of conventional polyisobutylene-substituted succinimide detergents in fuel oils. Specifically, it has been observed that the presence of high levels of detergent species in premium grade fuels can interfere with the cold-flow performance of wax anti-settling additives when these are also present in the fuel. So, although the fuel may be satisfactory from an engine cleanliness viewpoint, it's cold-flow performance, in terms of wax anti-settling and cold filter plugging point (CFPP) may not be adequate.

The present invention is based on the discovery that the use of alternative species to the conventionally used fuel oil detergents, in addition to providing detergency properties, do not have the same detrimental effect on the cold-flow performance of wax anti-settling additives.

WO95/03377 describes that certain fuel additives not known for providing improvements in low temperature properties can nevertheless be beneficial to such properties when combined with copolymeric ethylene flow improvers. Oil soluble ashless dispersants are disclosed as one such class of fuel additives. Further additives including wax anti-settling additives may additionally be incorporated.

EP 0 632 123 A1 describes fuel compositions comprising nitrogen-containing dispersant additives. A wide range of suitable species are disclosed including conventional polyisobutylene-substituted succinimide and those derived from hydrazines.

Thus in accordance with a first aspect, the present invention provides fuel oil composition comprising a major proportion of a fuel oil and minor amounts of:

(a) at least one polar nitrogen compound effective as a wax anti-settling additive; and (b) at least one reaction product between a hydrocarbyl-substituted succinic acid or anhydride and hydrazine.

In accordance with a second aspect, there is provided a method of improving the detergency properties of a fuel oil composition comprising a major amount of a fuel oil and a minor amount of (a) at least one polar nitrogen compound effective as a wax anti-settling additive whilst not substantially adversely affecting the cold flow properties of the fuel oil composition, the method comprising adding to the composition a minor amount of (b) as defined in relation to the first aspect.

The term whilst not substantially adversely affecting the cold flow properties of the fuel oil composition in the context of this second aspect should be understood to mean that the addition of the detergent species (b) does not have a significant negative influence on the cold-flow properties of the fuel oil containing the polar nitrogen compound effective as a wax anti-settling additive (a) compared to the situation where (b) is absent. It is not required that the cold-flow properties are improved in absolute terms, merely that they are at least substantially similar. Of course, an improvement in absolute terms is also within the scope of the present invention.

In accordance with a third aspect, the present invention provides the use of (b), as defined in relation to the first aspect, to improve the detergency properties of a fuel oil composition comprising a major amount of a fuel oil and a minor amount of (a) at least one polar nitrogen compound effective as a wax anti-settling additive; wherein the cold-flow properties of the fuel oil composition comprising (a) and (b) are at least substantially similar to the cold flow properties of the fuel oil composition comprising (a) in the absence of (b).

The term 'at least substantially similar' in the context of this third aspect is used to indicate that, in common with the method of the second aspect, the addition of component (b), does not negatively influence the cold-flow properties of the fuel oil containing component (a) to a significant extent. It will again be understood, that this term also encompasses any improvement in cold-flow properties resulting from the use.

As alluded to above, it has been observed that there may be a negative interaction between a conventional polyisobutylene-substituted succinimide detergent and WASA species. The use of alternative species in the present invention allows detergency to be achieved in the presence of WASA species without compromising the low temperature properties of the additised fuel oil.

As discussed above, the problem associated with a negative interaction between conventional polyisobutylene-substituted succinimide detergents and WASA species is most pronounced when high levels of detergent are used, for example in premium grade diesel fuels. The present invention also contemplates the situation where a conventional polyisobutylene-substituted succinimide detergent may be present in a fuel oil at a level where the negative interaction does not give rise to significant problems in terms of low temperature properties. However, the detergency performance may then not be adequate. The addition of component (b) allows a higher level of detergency to be provided without compromising the low temperature properties of the fuel oil. Thus in an embodiment applicable to all aspects, the fuel oil further comprises a minor amount of at least one polyisobutylene-substituted succinimide detergent. Such species are well known in the art.

The various features of the invention, which are applicable to all aspects, will now be described in more detail.

(a) The Polar Nitrogen Compound Effective as a Wax Anti-settling Additive

Such species are known in the art.

Preferred are oil-soluble polar nitrogen compounds carrying one or more, preferably two or more, substituents of the formula $>NR^{13}$, where $R^{13}$ represents a hydrocarbyl group containing 8 to 40 atoms, which substituent or one or more of which substituents may be in the form of a cation derived therefrom. The oil soluble polar nitrogen compound is generally one capable of acting as a wax crystal growth inhibitor in fuels. It comprises for example one or more of the following compounds:

An amine salt and/or amide formed by reacting at least one molar proportion of a hydrocarbyl-substituted amine with a molar proportion of a hydrocarbyl acid having from 1 to 4 carboxylic acid groups or its anhydride, the substituent(s) of formula $>NR^{13}$ being of the formula $—NR^{13}R^{14}$ where $R^{13}$ is defined as above and $R^{14}$ represents hydrogen or $R^{13}$, provided that $R^{13}$, and $R^{14}$ may be the same or different, said substituents constituting part of the amine salt and/or amide groups of the compound.

Ester/amides may be used, containing 30 to 300, preferably 50 to 150, total carbon atoms. These nitrogen compounds are described in U.S. Pat. No. 4,211.534. Suitable amines arc predominantly $C_{12}$ to $C_{40}$ primed secondary, tertiary or quaternary amines or mixtures thereof but shorter chain amines may be used provided the resulting nitrogen compound is oil soluble, normally containing about 30 to 300 total carbon atoms. The nitrogen compound preferably contains at least one straight chain $C_8$ to $C_{40}$, preferably $C_{14}$ to $C_{24}$, alkyl segment.

Suitable amines include primary, secondary, tertiary or quaternary, but are preferably secondary. Tertiary and quaternary amines only form amine salts. Examples of amines include tetradecylamine, cocoamine, and hydrogenated tallow amine. Examples of secondary amines include di-octadecylamine, di-cocoamine, di-hydrogenated tallow amine and methylbehenyl amine. Amine mixtures are also suitable such as those derived from natural materials. A preferred amine is a secondary hydrogenated tallow amine, the alkyl groups of which are derived from hydrogenated tallow fat composed of approximately 4% $C_{14}$, 31% $C_{16}$, and 59% $C_{18}$.

Examples of suitable carboxylic acids and their anhydrides for preparing the nitrogen compounds include ethylenediamine tetraacetic acid, and carboxylic acids based on cyclic skeletons, e.g., cyclohexane-1,2-dicarboxylic acid, cyclohexene-1,2-dicarboxylic acid, cyclopentane-1,2-dicarboxylic acid and naphthalene dicarboxylic acid, and 1,4-dicarboxylic acids including dialkyl spirobislactones. Generally, these acids have about 5 to 13 carbon atoms in the cyclic moiety. Preferred acids useful in the present invention are benzene dicarboxylic acids, e.g. phthalic acid, isophthalic acid, and terephthalic acid. Phthalic acid and its anhydride are particularly preferred. The particularly preferred compound is the amide-amine salt formed by reacting 1 molar portion of phthalic anhydride with 2 molar portions of dihydrogenated tallow amine.

Other examples are long chain alkyl or alkylene substituted dicarboxylic acid derivatives such as amine salts of monoamides of substituted succinic acids, examples of which are known in the art and described in U.S. Pat. No. 4,147,520, for example. Suitable amines may be those described above.

Other examples are condensates, for example, those described in EP-A-327423.

Other examples of polar nitrogen compounds are compounds containing a ring system carrying at least two substituents of the general formula below on the ring system $$-A-NR^{15}R^{16}$$

where A is a linear or branched chain aliphatic hydrocarbylene group optionally interrupted by one or more hetero atoms, and $R^{15}$ and $R^{16}$ are the same or different and each is independently a hydrocarbyl group containing 9 to 40 atoms optionally interrupted by one or more hetero atoms, the substituents being the same or different and the compound optionally being in the form of a salt thereof. Advantageously, A has from 1 to 20 carbon atoms and is preferably a methylene or polymethylene group. Such compounds are described in WO 93/04148 and WO09407842.

Other examples are the free amines themselves as these are also capable of acting as wax crystal growth inhibitors in fuels. Suitable amines including primary, secondary tertiary or quaternary, but are preferably secondary. Examples of amines include tetradecylamine, cocoamine, and hydrogenated tallow amine. Examples of secondary amines include di-octadecylamine, di-cocoamine, di-hydrogenated tallow amine and methylbehenyl amine. Amine mixtures are also suitable such as those derived from natural materials. A preferred amine is a secondary hydrogenated tallow amine, the alkyl groups of which are derived from hydrogenated tallow fat composed of approximately 4% $C_{14}$, 3 1% $C_{16}$, and 59% $C_{18}$.

b) Reaction Product Between a Hydrocarbyl-substituted Succinic Acid or Anhydride and Hydrazine.

The species suitable as component (b) are products of the reaction between a hydrocarbyl-substituted succinic acid or anhydride and hydrazine.

(i) Hydrocarbyl-substituted Succinic Acid or Anhydride.

As used in this specification the term "hydrocarbyl" to a group having a carbon atom directly attached to the rest of the molecule ad having a hydrocarbon or predominantly hydrocarbon character. They may be saturated or unsaturated, linear or branched. Preferably, the hydrocarbyl groups are hydrocarbon groups. These groups may contain non-hydrocarbon substituents provided their presence does not alter the predominantly hydrocarbon character of the group. Examples include keto, halo, nitro, cyano, alkoxy and acyl. The groups may also or alternatively contain atoms other than carbon in a chain otherwise composed of carbon atoms. Suitable hetero atoms include, for example, nitrogen, sulphur, and oxygen. Advantageously, the hydrocarbyl groups are alkyl groups.

Preferably, the hydrocarbyl group of the hydrocarbyl-substituted succinic acid or anhydride comprises a $C_8$-$C_{36}$ group, preferably a $C_8$-$C_{18}$ group. Non-limiting examples include dodecyl, hexadecyl and octadecyl. Alternatively, the hydrocarbyl group may be a polyisobutylene group with a number average molecular weight of between 200 and 2500, preferably between 800 and 1200. Mixtures of species with different length hydrocarbyl groups are also suitable, e.g. a mixture of $C_{16}$-$C_{18}$ groups.

The hydrocarbyl group is attached to a succinic acid or anhydride moiety using methods known in the art. Additionally, or alternatively, suitable hydrocarbyl-substituted succinic acids or anhydrides are commercially available e.g. dodecylsuccinic anhydride (DDSA), hexadecylsuccinic anhydride (HDSA), octadecylsuccinic anhydride (ODSA) and polyisobutylsuccinic anhydride (PIBSA).

(ii) Hydrazine

Hydrazine has the formula:

$$NH_2—NH_2$$

Hydrazine may be hydrated or non-hydrated. Hydrazine monohydrate is preferred.

(iii) Reaction of (i) and (ii)

The reaction between the hydrocarbyl-substituted succinic acid or anhydride and hydrazine produces a variety of products. Preferably, the reaction product predominates in species with relatively high molecular weight. The precise nature of the species produced in the reaction has not yet been fully elucidated however, it is presently thought that a major high molecular weight product of the reaction is an oligomeric species of the structure:

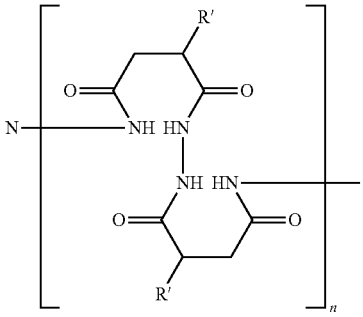

where n is an integer and greater than 1, preferably between 2 and 10, more preferably between 2 and 7, for example 3, 4 or 5.

Also thought to be present is a species of the structure:

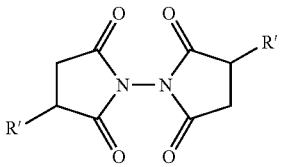

where R' represents the hydrocarbyl substituent. It should be noted that it is also within the scope of the present invention to use more than one hydrocarbyl-substituted succinic acid or anhydride in which case the groups R' in the above structures may be different from one another.

Both of the above structures contain at least two moieties derived from the hydrocarbyl-substituted succinic acid or anhydride. The molecular weights of these species are thus more than twice the average molecular weight of the hydrocarbyl substituent R'. In the context of the present invention the species are thus of relatively high molecular weight.

As lower molecular weight reaction products, species of the following structures are also thought to be present,

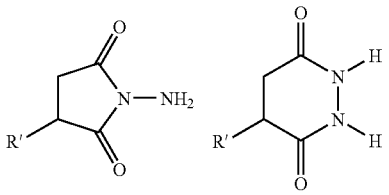

Further possible minor products include:

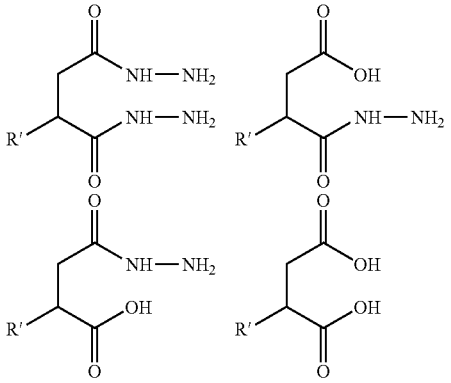

There may also be some salt formation resulting in species of the following structures:

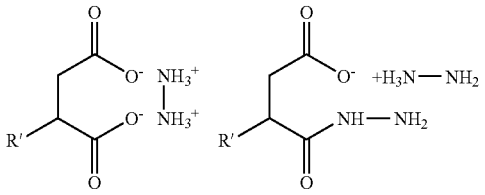

The general synthesis of the reaction products used in the present invention has been described in the art, for example, U.S. Pat. Nos. 3,375,092, 2,640,005 and 3,723,460 cited hereinabove. A range of possible reaction schemes and products has also been given by Feuer et al., in *Jn. Amer. Chem. Soc,* 73 (1951) pp. 4716-4719. By way of example a possible preparative route is as follows.

A charge of alkyl-substituted succinic anhydride together with an equal weight of solvent, e.g. toluene is heated to ca. 50° C. under nitrogen. The desired amount of hydrazine hydrate is added drop-wise causing an exotherm. Once addition is complete, the reaction mixture is heated to reflux for several hours. The mixture is then water/solvent stripped and the temperature raised to 180° C. under vacuum.

Preferably, the hydrocarbyl-substituted succinic acid or anhydride and hydrazine are reacted in a molar ratio of between 2:1 and 1:4, more preferably between 1:1-1:3.

Preferably, the reaction product between the hydrocarbyl-substituted succinic acid or anhydride and hydrazine is added to the diesel fuel in an amount of between 50 and 500 ppm by weight, based on the weight of the fuel.

The Fuel Oil

The fuel oil may be, e.g., a petroleum-based fuel oil, especially a middle distillate fuel oil. Such distillate fuel oils generally boil within the range of from 110° C. to 500° C., e.g. 150° C. to 400° C.

The invention is applicable to middle distillate fuel oils of all types, including the broad-boiling distillates, i.e., those having a 90%-20% boiling temperature difference, as measured in accordance with ASTM D-86, of 50° C. or more.

The fuel oil may comprise atmospheric distillate or vacuum distillate, cracked gas oil, or a blend in any proportion of straight run and thermally anchor catalytically cracked distillates. The most common petroleum distillate fuels are kerosene, jet fuels, diesel fuels, heating oils and heavy fuel oils. The heating oil may be a straight atmospheric distillate, or may also contain vacuum gas oil or cracked gas oil or both. The fuels may also contain major or minor amounts of components derived from the Fischer-Tropsch process. Fischer-Tropsch fuels also known as FT fuels, include those that are described as gas-to-liquid fuels, coal and/or biomass conversion fuels. To make such fuels, syngas ($CO+H_2$) is first generated and then converted to normal paraffins and olefins by a Fischer-Tropsch process. The normal paraffins may then be modified by processes such as catalytic cracking/reforming or isomerisation hydrocracking and hydroisomerisation to yield a variety of hydrocarbons such as iso-paraffins, cyclo-paraffins and aromatic compounds. The resulting FT fuel can be used as such or in combination with other fuel components and fuel types such as those mentioned in this specification. The above mentioned low temperature flow problem is most usually encountered with diesel fuels and with heating oils. The invention is also applicable to fuel oils containing fatty acid methyl or ethyl esters derived from vegetable oils, for example, rapeseed methyl or ethyl ester, either used alone or in admixture with a petroleum distillate oil.

The fuel oil is preferably a low sulphur content fuel oil. Typically, the sulphur content of the fuel oil will be less than 500 ppm (parts per million by weight). Preferably, the sulphur content of the fuel will be less than 100 ppm, for example, less than 50 ppm. Fuel oils with even lower sulphur contents, for example less that 20 ppm or less than 10 ppm are also suitable.

Treat Rates

The amount of (a) at least one polar nitrogen compound effective as a wax anti-settling additive will typically be in the range of 10-300 ppm, preferably 10-100 ppm by weight based on the weight of the fuel oil.

It is commonplace in the art to use polar nitrogen compounds effective as a wax anti-settling additives in combination with other additional cold-flow improving additives. Suitable materials will be well known to those skilled in the art and include for example, ethylene-unsaturated ester copolymers such as EVA and similar polymers. The present invention contemplates the addition of such additional cold-flow improving additives; their application in terms of treat rate being also well known to those skilled in the art. In an embodiment, the fuel oil further comprises an ethylene-unsaturated ester copolymer.

The amount of component (b) present in the fuel oil will suitably be between 50 and 250 ppm by weight based on the weight of the fuel oil, preferably between 50 and 200 ppm, for example between 100 and 200 ppm, For the avoidance of doubt, the present invention ascribes no importance to the order in which the various components may be added to the fuel oil. Embodiments where each component is added separately to the fuel oil, where all components are added simultaneously to the fuel oil, or where one or more components is added to a fuel oil which already contains another component are all intended to be within the scope of the invention.

Evaluation of Cold-flow Performance.

The method of the second aspect and the use of the third aspect require that the low temperature properties of the fuel oil composition be measured. As is known in the art, there are a number of methods which can be used to determine the low temperature properties of a fuel oil. Preferably, the low temperature properties are as determined by measuring ΔCP, CFPP, or both. Preferably, the low temperature properties improved in all relevant aspects of the present invention are ΔCP, CFPP, or both.

ΔCP is a measurement of the propensity of the wax content of a fuel oil to settle and thus a determination of the effectiveness of a wax anti-settling additive. To determine ΔCP, the cloud point (CP) of a base fuel oil is measured. The wax anti-settling additive under study is then added to the base fuel and the sample cooled to a temperature below the measured CP. This temperature may vary, in Germany a temperature of −13° C. is commonly used, in South Korea it maybe −15 or −20° and a value of −18° C. is also often used. After leaving the fuel oil sample for a time to allow any wax to settle, the CP of the bottom 20% by volume of the sample is measured. The difference between this measurement and the value obtained for the base fuel is ΔCP. A small value, preferably around zero, of ΔCP indicates good wax dispersancy.

CFPP is a standard industry test to evaluate the ability of a fuel oil sample to flow through a filter at reduced temperature. The test which is carried out by the procedure described in detail in "*Jn. Of the Institute of Petroleum*", vol. 52, No. 510 (1996), pp 173-285, is designed to correlate with the cold flow of a middle distillate in automotive diesels. In brief, a sample of the oil to be tested (40 $cm^3$) is cooled in a bath which is maintained at about −34° C. to give linear cooling at about 1° C./min. Periodically (at each one degree centigrade starting from above the cloud point), the oil is tested for its ability to flow through a fine screen in a prescribed time period using a test device which is a pipette to whose lower end is attached an inverted funnel which is positioned below the surface of the oil to be tested. Stretched across the mouth of the funnel is a 350 mesh screen having an area defined by a 12 mm diameter. The periodic tests are initiated by applying a vacuum to the upper end of the pipette whereby oil is drawn through the screen up into the pipette to a mark indicating 20 $cm^3$ of oil. After each successful passage, the oil is returned immediately to the CFPP tube. The test is repeated with each one degree drop in temperature until the oil fails to fill the pipette within 60 seconds, the temperature at which failure occurs being reported as the CFPP temperature.

The invention will now be described by way of example only.

In the experiments detailed below, a low-sulphur content diesel fuel containing a fixed amount (48 ppm) of a polar nitrogen compound effective as a wax anti-settling additive and varying amounts of species (b) was tested for ΔCP and CFPP. Tests using conventional polyamine detergents and tests with no detergent were also conducted for comparative purposes.

The polar nitrogen compound effective as a wax antisettling additive used was an N,N-dialkylammonium salt of 2-N',N' dialkylamidobenzoate, the product of reacting one mole of phthalic anhydride and two moles of di(hydrogenated tallow) amine.

The conventional polyamine detergents used were: a PIBSA-PAM detergent being the product of reacting a polyisobutylene-substituted succinic anhydride, the polyisobutylene group having a molecular weight of ca. 1000, with a polyamine mixture predominating in species having at least seven nitrogen atoms per molecule (D1); the product of the reaction between succinic anhydride substituted by a mixture of polypropylenes predominating in $C_{18}$-$C_{29}$ species with a polyamine mixture (D2); the product of reacting dodecylsuccinic anhydride with a polyamine mixture (D3); and, the product of reacting dodecylsuccinic anhydride with tetraethylenepentamine (D4).

For all tests, the diesel fuel also contained fixed amounts of additional cold-flow additives. These are typical of additives routinely used in commercial diesel fuels and were mainly ethylene-unsaturated ester co-polymers and fumarate vinyl acetate co-polymers. All amounts are given in ppm of active ingredient (i.e. ingredient which is not solvent or carrier) by weight, based on the weight of the fuel, Results are given in Table 1 below.

TABLE 1

| Example | Detergent(*)/ppm | CFPP/° C. | ΔCP/° C. |
|---|---|---|---|
| 1 | — | −26.5 | 0.6 |
| 2 | (D1) 84 | −23.3 | 2.4 |
| 3 | (D1) 108 | −25.5 | 6.4 |
| 4 | (D1) 127 | −20.0 | 8.1 |
| 5 | (D2) 100 | −19.5 | 7.8 |
| 6 | (D2) 150 | −19.5 | 7.1 |
| 7 | (D3) 180 | −19.0 | 3.6 |
| 8 | (D4) 100 | −19.0 | 8.1 |
| 9 | (D4) 150 | −20.0 | 7.8 |
| 10 | (A) 100 | −26.0 | −0.1 |
| 11 | (A) 150 | −23.0 | 0.0 |
| 12 | (B) 100 | −25.0 | 0.5 |
| 12 | (B) 150 | −26.0 | 0.2 |
| 14 | (C) 100 | −26.0 | 0.3 |
| 15 | (C) 150 | −28.0 | 1.3 |
| 16 | (E) 180 | −26.0 | 0.6 |
| 17 | (F) 180 | −26.0 | 0.5 |

[*(A) = the product of the reaction between a mixture of polypropylenes predominating in $C_{18}$-$C_{29}$ succinic anhydride species with hydrazine, (B) = the product of the reaction between a polyisobutenyl-substituted succinic (PIB ~1000 MW) anhydride with hydrazine, (C) = the product of the reaction between dodecylsuccinic anhydride with hydrazine,, (E) = the product of the reaction between dodecylsuccinic anhydride with hydrazine solvent stripped at >180° C., (F) = the product of the reaction between dodecylsuccinic anhydride with hydrazine solvent stripped at <120° C.]

It is clear from Table 1 that all of the conventional polyamine detergents have a negative influence on both ΔCP ad CFPP (compare Example 1 with Examples 2-9). Contrastingly, Examples 10-17 show that species (b), even at relatively high treat rates, have a very much smaller, if any, influence on either ΔCP As discussed above, in an embodiment, the fuel oil may additionally comprise a minor amount of at least one polyisobutylene-substituted succinimide detergent. Table 2 below gives results showing species (A)-(C) of Table 1 being used together with a conventional detergent without compromise to the low temperature properties of the fuel oil. The conventional detergent used was D1.

TABLE 2

| Example | Detergent/ppm | CFPP/° C. | ΔCP/° C. |
|---|---|---|---|
| 20 | (D1) 12.5 + (A) 135 | −24.0 | 1.0 |
| 21 | (D1) 25 + (A) 120 | −26.0 | 0.8 |
| 22 | (D1) 12.5 + (B) 135 | −27.0 | 0.5 |
| 23 | (D1) 25 + (B) 120 | −27.0 | 0.3 |
| 24 | (D1) 12.5 + (C) 135 | −26.5 | 0.7 |
| 25 | (D1) 25 + (C) 120 | −23.5 | 0.8 |

Evaluation of Detergency Properties.

Species (A)-(F) were also tested for their detergency properties. The protocol used was as described by Graupner et at. "*Injector deposit test for modern diesel engines", Technische Akadermie Esslingen, 5th International Colloquium,* 12-13 January 2005, 3.10, p 157, Edited by Wilfried J Bartz. Briefly, the protocol aims to replicate the operating conditions in a modern diesel engine with an emphasis on the fuel injector tip. The test is split into five stages:

a) an iso-speed measurement of engine power output b) an 8 hour endurance run c) an extended soaking period (3to 8 hours) during which the engine is stopped and allowed to cool d) a second 8 hour endurance run e) an iso-speed measurement of engine power output.

Results are reported as the difference between the average torque at the stat of the test during stage a) and the average torque at the end of the test during stage e). Alternatively, the measured difference between starting torque at full load/full speed and final load/speed can be used. Differences in smoke production are also noted. The formation of injector deposits will have a negative influence on the final power output and will increase the amount of smoke observed.

To replicate the conditions expected in a modern diesel engine, a small amount (3 wppm) of metal contamination in the form of zinc neodecanoate was added to the fuel used to run the engine. Results are given in Table 3 below.

TABLE 3

| Species | Treat rate/wppm | Torque Loss |
|---|---|---|
| Base Fuel | — | 15.3% |
| A | 60 | 7.1% |
| A | 120 | 2.6% |
| B | 60 | 9.8% |
| C | 60 | 5.2% |
| E | 60 | 5.2% |
| E | 120 | 3.4% |
| E | 180 | 0.1% |
| F | 60 | 12.0% |

The results show that the species used provide both detergency properties and do not adversely affect the low temperature properties of a fuel oil when the fuel oil contains a polar nitrogen compound effective as a wax anti-settling additive.

What is claimed is:

1. A fuel oil composition comprising a major proportion of a fuel oil and minor amounts of:

(a) at least one polar nitrogen compound effective as a wax anti-settling additive; and (b) an oligomeric species of the structure:

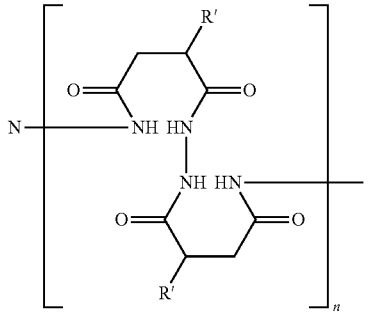

where n is an integer and greater than 1.

2. A fuel oil composition according to claim 1 wherein component (a) comprises an oil-soluble polar nitrogen compound carrying one or more, substituents of the formula $>NR^{13}$, where $R^{13}$ represents a hydrocarbyl group containing 8 to 40 atoms, which substituent or one or more of which substituents may be in the form of a cation derived therefrom.

3. A fuel oil composition according to claim 2 wherein, component (a) comprises an amide-amine salt formed by reacting 1 molar portion of phthalic anhydride with 2 molar portions of dihydrogenated tallow amine.

4. A fuel oil composition according to claim 1 wherein component (a) is present in the fuel oil in an amount of between 10 -300 ppm by weight based on the weight of the fuel oil.

5. A fuel oil composition according to claim 1 further comprising a minor amount of at least one polyisobutylene-substituted succinimide detergent.

6. A fuel oil composition according to claim 1 further comprising an ethylene-unsaturated ester copolymer.

7. A fuel oil composition according to claim 1 wherein the fuel oil comprises a middle distillate fuel oil.

8. A method of improving the detergency properties of a fuel oil composition comprising a major amount of a fuel oil and a minor amount of (a) at least one polar nitrogen compound effective as a wax anti-settling additive whilst not substantially adversely affecting the cold flow properties of the fuel oil composition, comprising adding to the composition minor amounts of (b) as recited in claim 1.

9. The fuel oil composition according to claim 1 wherein n is between 2 and 10.

10. The fuel oil composition according to claim 1 wherein n is between 2 and 7.

11. The fuel oil composition according to claim 1 wherein n is 3, 4 or 5.

* * * * *